US009281587B2

(12) United States Patent
Komoto

(10) Patent No.: US 9,281,587 B2
(45) Date of Patent: Mar. 8, 2016

(54) THIN CONNECTOR HAVING A FIRST CONNECTOR SLIDABLY SUPERIMPOSED ON A SECOND CONNECTOR

(71) Applicant: Japan Aviation Electronics Industry, Limited, Tokyo (JP)

(72) Inventor: Tetsuya Komoto, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/539,704

(22) Filed: Nov. 12, 2014

(65) Prior Publication Data

US 2015/0162679 A1 Jun. 11, 2015

(30) Foreign Application Priority Data

Dec. 11, 2013 (JP) ..... 2013-256095

(51) Int. Cl.
*H01R 12/71* (2011.01)
*H01R 12/73* (2011.01)

(52) U.S. Cl.
CPC ..... *H01R 12/716* (2013.01); *H01R 12/714* (2013.01); *H01R 12/73* (2013.01)

(58) Field of Classification Search
CPC .. H01R 12/712; H01R 12/714; H01R 12/716; H01R 12/718; H01R 13/15; H01R 13/62; H01R 13/193; H01R 23/6813; H01R 23/6833
USPC ..... 439/670, 629, 259–265, 342
See application file for complete search history.

(56) References Cited

U.S. PATENT DOCUMENTS 5,395,250 A * 3/1995 Englert, Jr. ..... H01R 12/716 439/65
8,888,506 B2 * 11/2014 Nishimura ..... H01R 12/7082 439/74
2005/0009379 A1 * 1/2005 Huang ..... H01R 12/716 439/65
2012/0270446 A1 * 10/2012 Shibata ..... H01R 12/716 439/629
2014/0004752 A1 * 1/2014 Sagayama ..... H01R 12/89 439/670
2014/0162679 A1 * 6/2014 Harel ..... H04W 16/28 455/452.2

FOREIGN PATENT DOCUMENTS

JP 2012-226977 11/2012

* cited by examiner

*Primary Examiner* — Chandrika Prasad
(74) *Attorney, Agent, or Firm* — Muncy, Geissler, Olds & Lowe, P.C.

(57) ABSTRACT

A thin connector comprises a first connector having a flat plate shape and a second connector having a flat plate shape superimposed on and fitted with each other, the first connector including first contacts arrayed in a direction, each first contact having a spring portion composed of a first metal member in a flat plate shape, a projection portion formed on the spring portion so as to protrude in a perpendicular direction to the plane of the first metal member, and a first contact portion formed on a side surface of the projection portion, the second connector including second contacts arrayed in a same direction as the direction in which the first contacts are arrayed, each second contact being composed of a second metal member in a flat plate shape and having a second contact portion formed on a side surface of the second metal member.

6 Claims, 11 Drawing Sheets

THIN CONNECTOR HAVING A FIRST CONNECTOR SLIDABLY SUPERIMPOSED ON A SECOND CONNECTOR

BACKGROUND OF THE INVENTION

The present invention relates to a thin connector, in particular, to a substrate-to-substrate connector comprising a first connector having a flat plate shape and a second connector having a flat plate shape superimposed on and fitted with each other in a fitting plane.

As a connector of this type, for example, JP 2012-226977 A discloses a connector as illustrated in FIG. 18. The connector comprises a receptacle 2 mounted on a first substrate 1 and a plug 4 (not shown) mounted on a second substrate 3. In the receptacle 2, a plurality of receptacle contacts 5 having spring characteristics are formed to be arrayed as illustrated in FIG. 19, and in the plug 4, protruding plug contacts 6 are formed to be arrayed as illustrated in FIG. 20.

Each of the receptacle contacts 5 has a main arm portion 5*a* curved so as to form inside thereof an opening portion S, an auxiliary arm portion 5*b* provided so as to face the main arm portion 5*a*, and a projection portion 5*c* provided in the vicinity of the tip end of the main arm portion 5*a* and the tip end of the auxiliary arm portion 5*b*, as illustrated in FIG. 21. The opening portion S is to receive the plug contact 6.

As illustrated in FIG. 22, upon superimposing the plug 4 on the receptacle 2, the protruding plug contacts 6 of the plug 4 are inserted into the opening portions S of the corresponding receptacle contacts 5, and in this state, the plug 4 mounted on the second substrate 3 is slid in the direction of the arrow C with respect to the receptacle 2 mounted on the first substrate 1 as illustrated in FIG. 23, whereby each of the protruding plug contacts 6 of the plug 4 moves as having its side surface kept in contact with the main arm portion 5*a* over the whole length thereof and is elastically caught among the tip end of the main arm portion 5*a*, the tip end of the auxiliary arm portion 5*b* and the projection portion 5*c*. Thus, the receptacle 2 and the plug 4 are fitted with each other, and the receptacle contacts 5 and the plug contacts 6 are electrically connected in this manner.

As above, having the protruding plug contacts 6 of the plug 4 inserted in the opening portions S formed in the receptacle contacts 5 of the receptacle 2, the receptacle 2 and the plug 4 are relatively slid so as to be fitted with each other. Hence, each of the receptacle contacts 5 has to necessarily have the opening portion S for receiving the protruding plug contact 6 and also a space capable of absorbing displacements of the main arm portion 5*a* and the auxiliary arm portion 5*b* caused by elastic deformation thereof in accordance with movement of the plug contact 6. Accordingly, reduction in size of the receptacle contact 5 has been limited, and it has been difficult to narrow the arrangement pitch of the receptacle contacts 5.

Moreover, in order to form the opening portion S inside the receptacle contact 5, the processing dimension, the arrangement pitch of the receptacle contacts 5, the width of the connector and the like are restricted. Hence, the freedom of design of the main arm portion 5*a* and the auxiliary arm portion 5*b* both having the spring characteristics in the receptacle contact 5 is small.

SUMMARY OF THE INVENTION

The present invention has been made in order to solve the conventional problems described above and is aimed at providing a thin connector capable of readily narrowing the arrangement pitch.

A thin connector according to the present invention comprises a first connector having a flat plate shape and a second connector having a flat plate shape superimposed on and fitted with each other in a fitting plane, wherein the first connector includes a plurality of first contacts arrayed in a direction, each of the plurality of first contacts having a spring portion composed of a first metal member in a flat plate shape extending in a plane, a projection portion formed on the spring portion so as to protrude in a perpendicular direction to the plane of the first metal member, and a first contact portion formed on a side surface of the projection portion, wherein the second connector includes a plurality of second contacts arrayed in a same direction as the direction in which the plurality of first contacts are arrayed, each of the plurality of second contacts being composed of a second metal member in a flat plate shape and having a second contact portion formed on a side surface of the second metal member, and wherein the first connector and the second connector are superimposed on each other in the fitting plane and are slid relatively to each other within the fitting plane so that the second contact portion of each of the plurality of second contacts in the second connector comes in contact with the first contact portion of a corresponding first contact among the plurality of first contacts in the first connector, whereby the first connector and the second connector are fitted with each other.

DETAILED DESCRIPTION OF THE INVENTION

Embodiments of the present invention will be described below based on the appended drawings.

Figure 1:
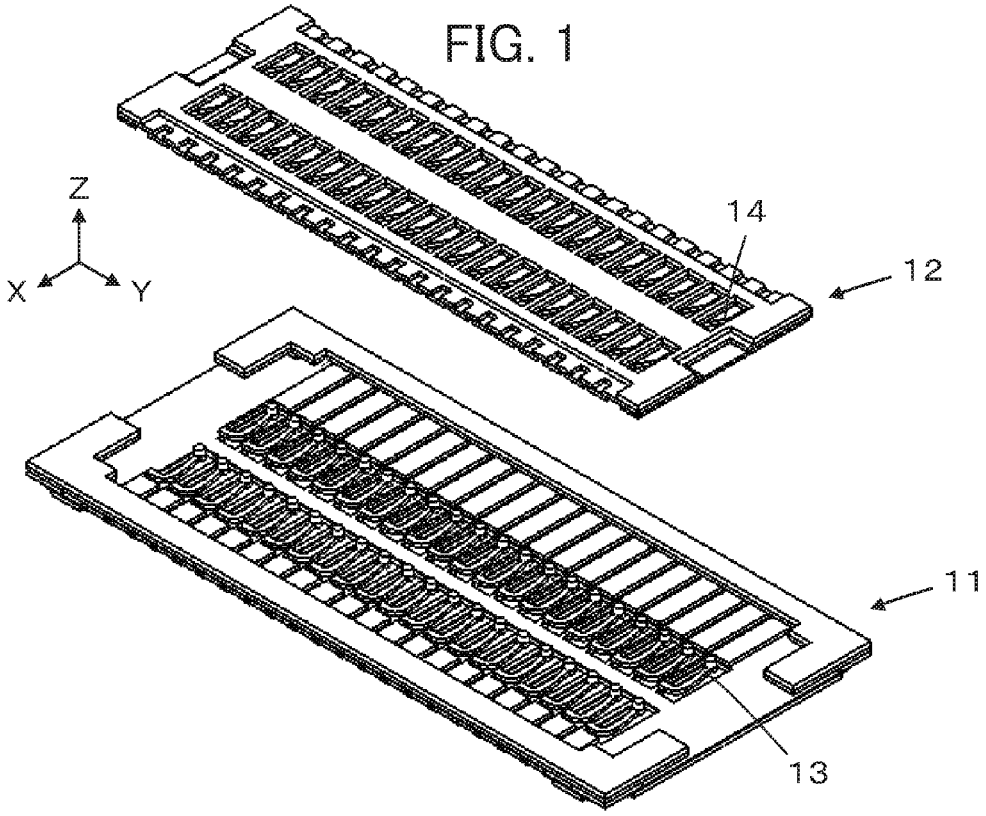
FIG. 1 is a perspective view of a receptacle and a plug of a thin connector, when viewed obliquely from above, according to an embodiment of the present invention.
Figure 2:
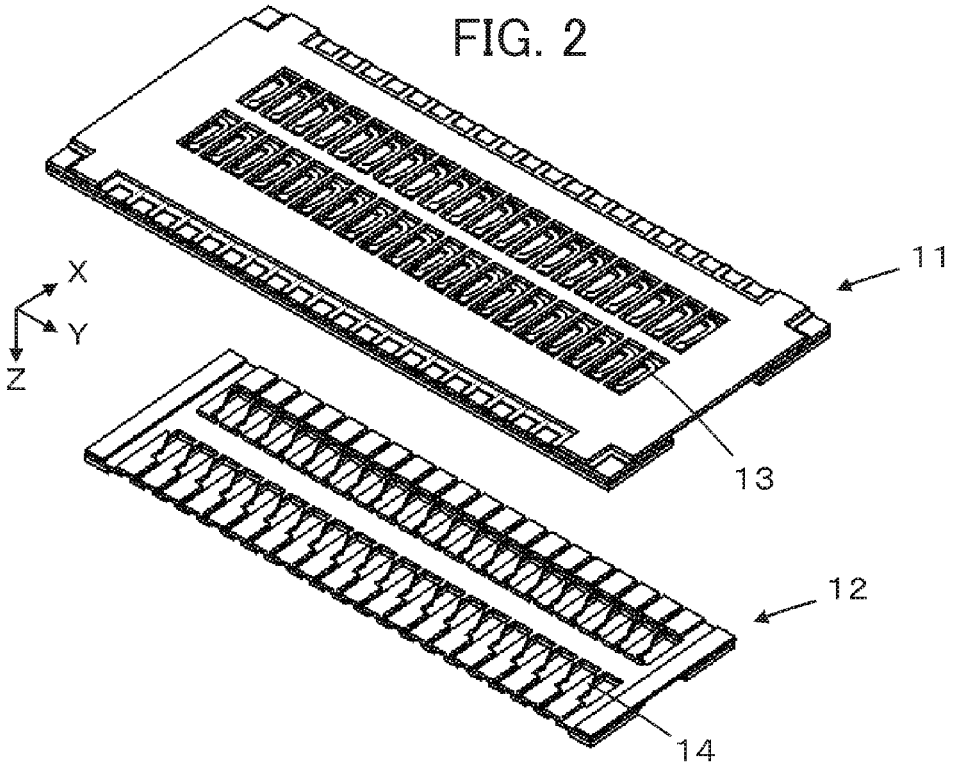
FIG. 2 is a perspective view of the receptacle and the plug of the thin connector, when viewed obliquely from below, according to the embodiment of the present invention.
Figure 3A:
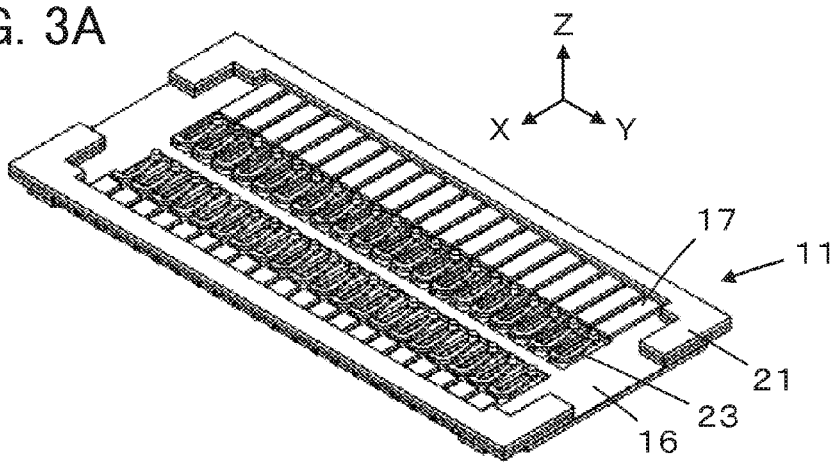
FIGS. 3A-3E are a perspective view when viewed obliquely from above, a plan view, a front view, a bottom view, and a side view, respectively, illustrating the receptacle.
Figure 3B:
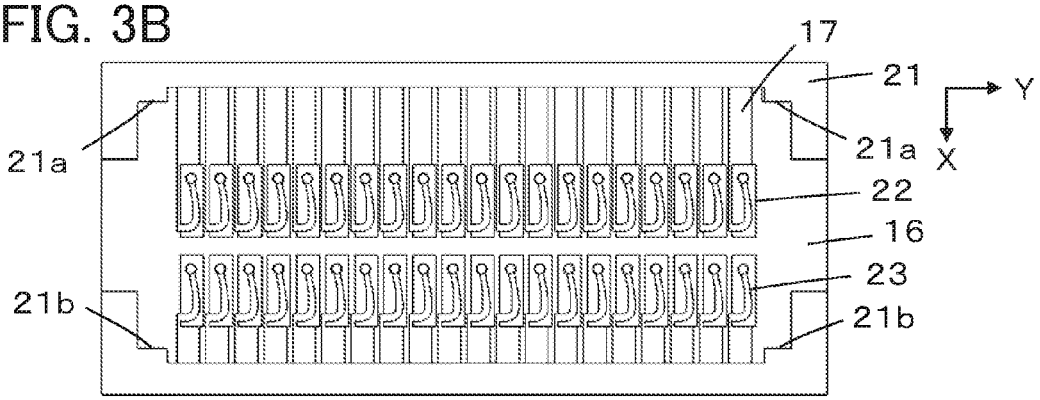
Figure 3C:
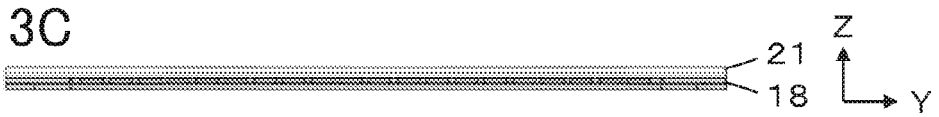
Figure 3D:
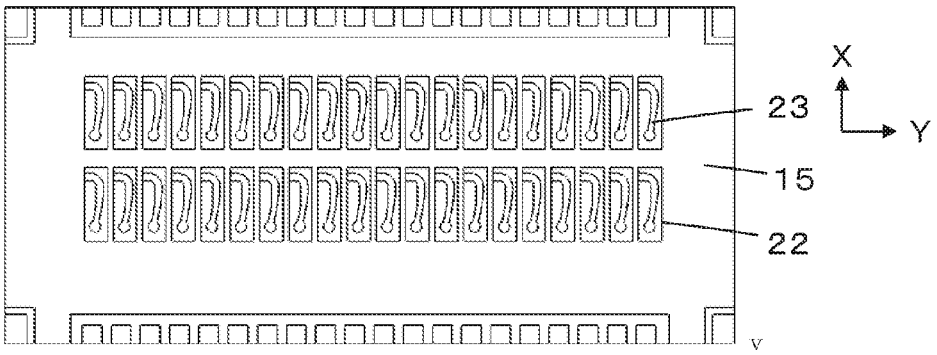
Figure 3E:
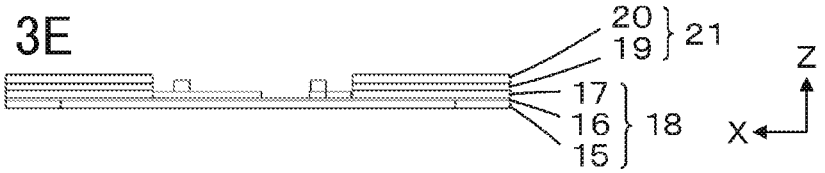
Figure 4:
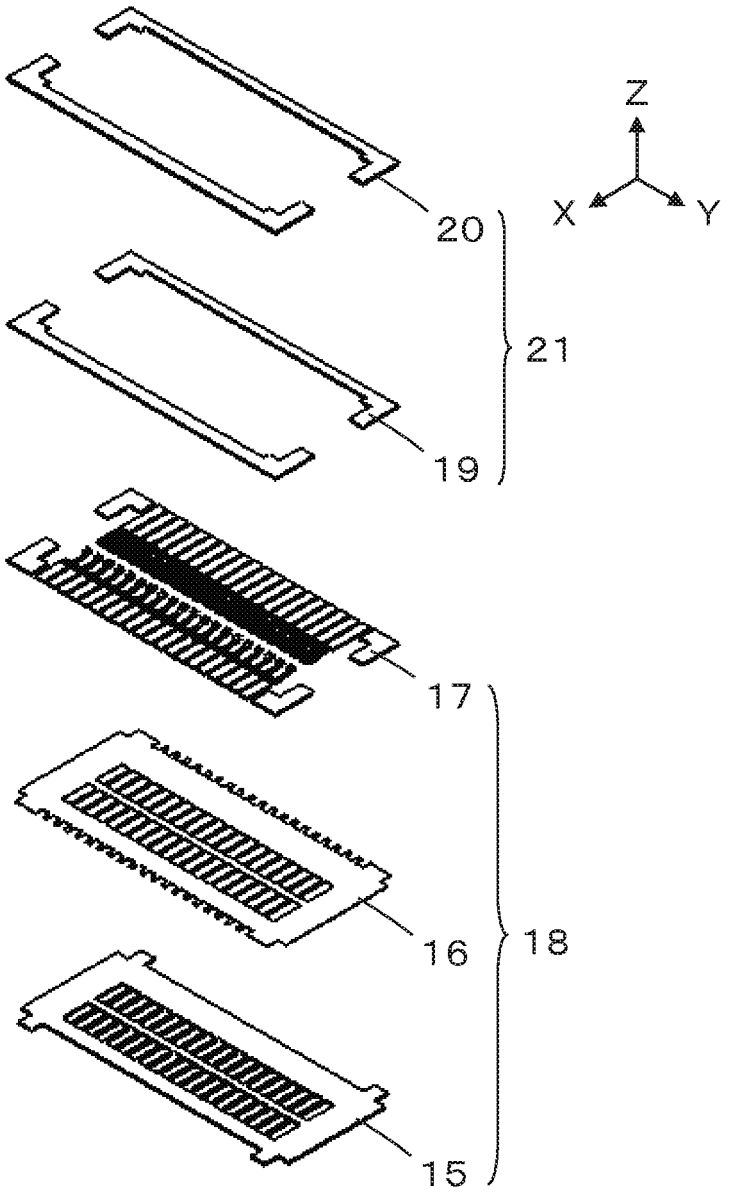
FIG. 4 is an exploded view of the receptacle.

FIGS. 1 and 2 illustrate a configuration of a thin connector according to an embodiment of the present invention. The thin connector comprises a flat plate receptacle (first connector) 11 and a flat plate plug (second connector) 12, and the receptacle 11 and the plug 12 are superimposed on each other to be fitted together. FIGS. 1 and 2 illustrate the receptacle 11 and the plug 12 that are placed in parallel and apart from each other, and FIG. 1 is a view when viewed obliquely from above while FIG. 2 is a view when viewed obliquely from below.

The receptacle 11 includes a plurality of receptacle contacts (first contacts) 13 arranged in two arrays, while the plug 12 includes a plurality of plug contacts (second contacts) 14 arranged in two arrays.

In this regard, a plane along which the flat plate receptacle 11 and the flat plate plug 12 extend is assumed to be an XY plane, and a direction in which the plurality of receptacle contacts 13 and the plurality of plug contacts 14 are arranged is assumed to be a Y direction, whereas the plug 12 is assumed to be placed apart from the receptacle 11 in a Z direction.

As illustrated in FIGS. 3A to 3E and FIG. 4, the receptacle 11 is produced by using a laminate 18 having a three-layer structure in which a reinforcing plate 15 made of stainless steel or the like, an insulating layer 16 made of polyimide or the like, and a conductive material (first metal member) 17 made of copper or the like are sequentially laminated, and further a frame 21 formed by laminating an insulating layer 19 and a reinforcing plate 20 is provided on the periphery of the upper surface of the laminate 18.

The frame 21 receives the plug 12 in such a manner that the plug 12 can slide in the X direction. The inner periphery of the frame 21 has a length in the Y direction approximately corresponding to the length of the plug 12 in the Y direction and has a length in the X direction longer than the length of the plug 12 in the X direction. Abutments 21*a* and 21*b* are formed at the four corners of the inner periphery of the frame 21. Among the abutments 21*a* and 21*b*, the pair of abutments 21*a* provided at the both ends of the frame 21 in the Y direction on the −X direction side face the +X direction, while the pair of abutments 21*b* provided at the both ends of the frame 21 in the Y direction on the +X direction side face the −X direction.

Figure 5:
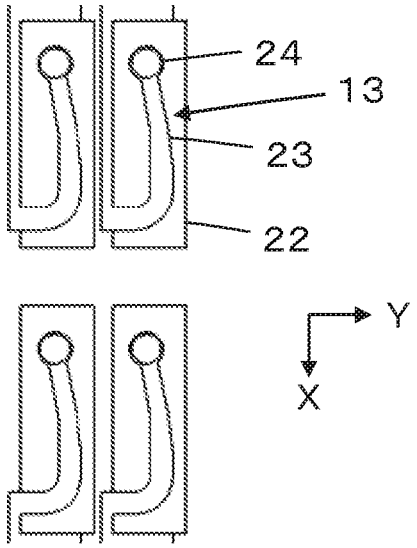
FIG. 5 is a plan view illustrating receptacle contacts used in the receptacle.
Figure 6:
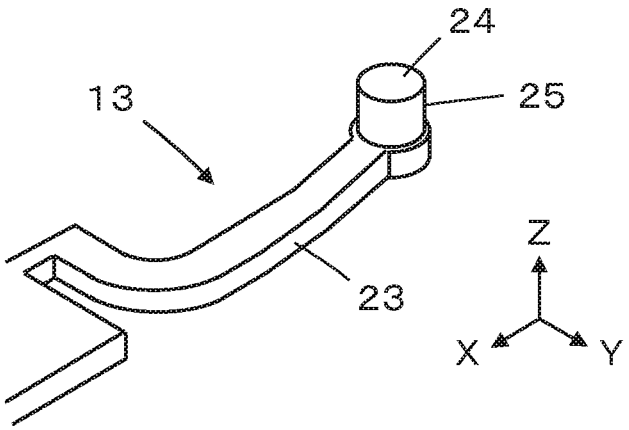
FIG. 6 is an enlarged perspective view illustrating the receptacle contact.
Figure 7A:
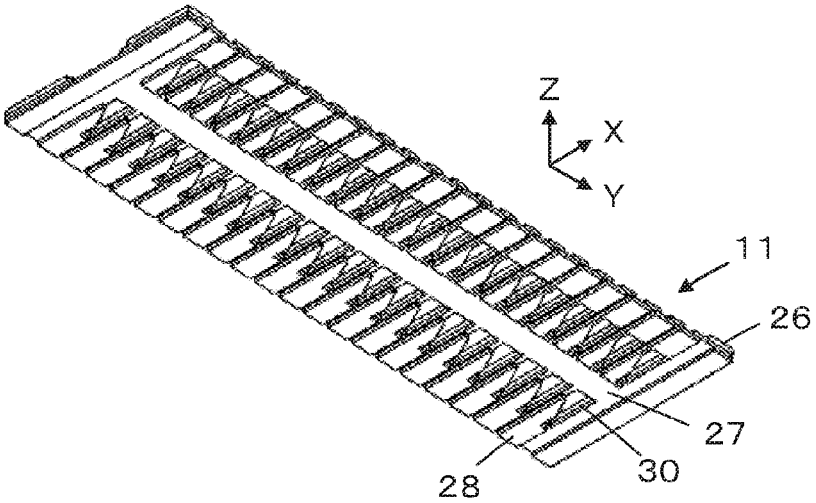
FIGS. 7A-7E are a perspective view when viewed obliquely from below, a plan view, a front view, a bottom view, and a side view, respectively, illustrating the plug.
Figure 7B:
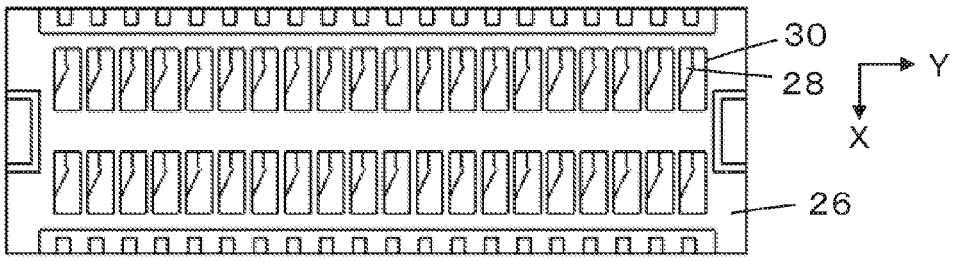
Figure 7C:
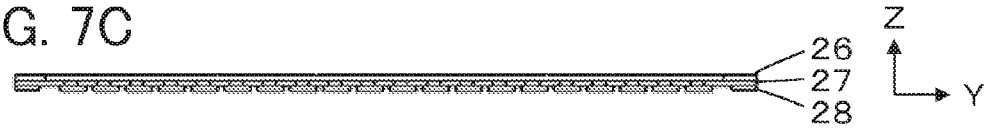
Figure 7D:
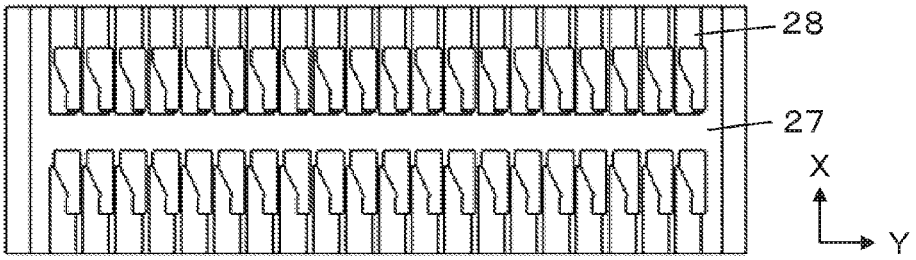
Figure 7E:
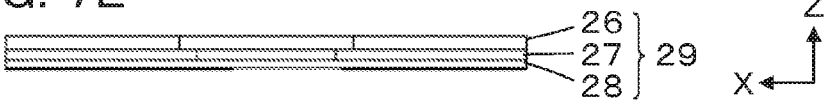
Figure 8:
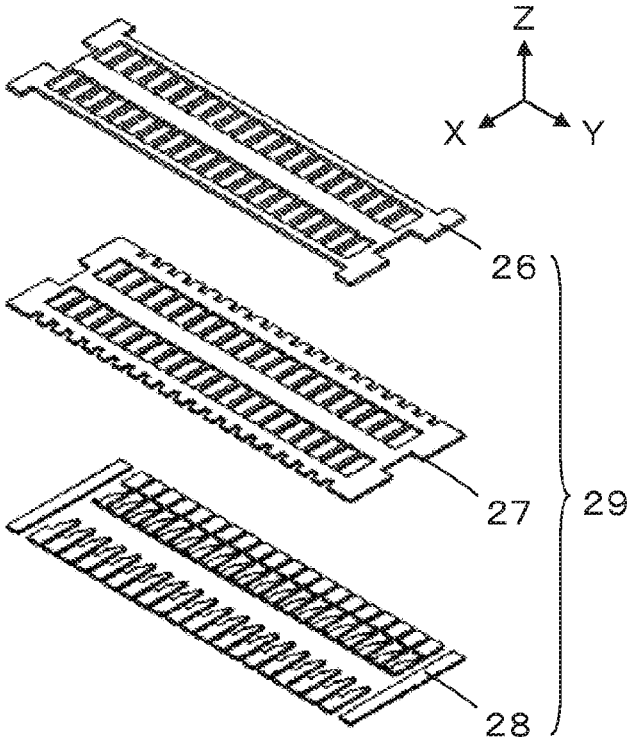
FIG. 8 is an exploded view of the plug.

A plurality of rectangular opening portions 22 respectively corresponding to the plurality of receptacle contacts 13 are formed in the reinforcing plate 15 and the insulating layer 16 of the laminate 18, and a spring portion 23 composed of the conductive material 17 is formed within each of the opening portions 22. The spring portion 23, as illustrated in FIG. 5, has a cantilever shape extending approximately in the −X direction within the XY plane, and a projection portion 24 is formed at the tip end of the spring portion 23. As illustrated in FIG. 6, the projection portion 24 has a columnar shape projecting in the perpendicular direction to the XY plane, i.e., in the +Z direction, and the side surface (outer circumferential surface) of the projection portion 24 forms a receptacle contact portion (first contact portion) 25. The spring portion 23 and the projection portion 24 constitute each of the receptacle contacts 13.

The receptacle 11 can be produced by forming the plurality rectangular opening portions 22 in both the reinforcing plate 15 and the insulating layer 16 of the laminate 18 having a flat plate shape through etching and also subjecting the conductive material 17 to etching to thereby form the spring portion 23 inside each of the opening portions 22, followed by forming the projection portion 24 at the tip end of the spring portion 23 through, for example, additive plating, and further attaching the frame 21 comprising the insulating layer 19 and the reinforcing plate 20 onto the periphery of the upper surface of the laminate 18.

As illustrated in FIGS. 7A to 7E and FIG. 8, the plug 12 is produced by using a laminate 29 having a three-layer structure in which a reinforcing plate 26 made of stainless steel or the like, an insulating layer 27 made of polyimide or the like, and a conductive material (second metal member) 28 made of copper or the like are sequentially laminated.

Figure 9:
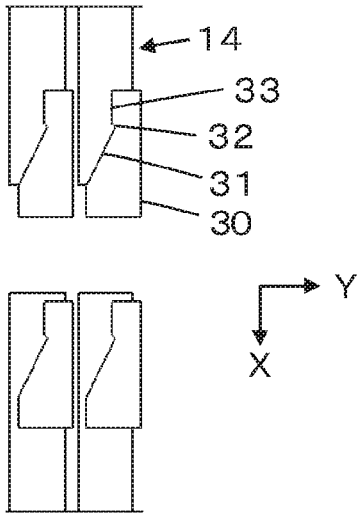
FIG. 9 is a plan view illustrating plug contacts used in the plug.

A plurality of rectangular opening portions 30 respectively corresponding to the plurality of plug contacts 14 are formed in the reinforcing plate 26 and the insulating layer 27 of the laminate 29. The plug contact 14, as illustrated in FIG. 9, includes a tapered portion 31, a plug-side projection 32 (second metal member-side projection) and a plug contact portion 33 (second contact portion) each formed on a side surface of the conductive material 28 by patterning the conductive material 28 in the XY plane. The tapered portion 31 is formed to be inclined with respect to the X direction such that the position thereof moves toward the +Y direction in the XY plane as advancing in the −X direction when observed from above, and the plug contact portion 33 is formed so as to extend in the X direction. The plug-side projection 32 is formed at the boundary between the tapered portion 31 and the plug contact portion 33 so as to protrude in the +Y direction.

The plug 12 can be produced by forming the plurality of rectangular opening portions 30 in both the reinforcing plate 26 and the insulating layer 27 of the laminate 29 having a flat plate shape through etching and also subjecting the conductive material 28 to etching to thereby form the tapered portion 31, the plug-side projection 32 and the plug contact portion 33 in each of the opening portions 30.

The thin connector according to the embodiment is a small-size connector, as small as having, for example, a length of 4 mm to 5 mm in the Y direction, a width of 2 mm to 3 mm in the X direction and a height of 0.3 mm to 0.5 mm in the Z direction. The opening portion 22 corresponding to each of the receptacle contacts 13 and the opening portion 30 corresponding to each of the plug contacts 14 are formed to have a small size such as a length of 0.3 mm in the Y direction and a length of 0.6 mm in the X direction.

Next, the behavior during fitting of the thin connector according to the embodiment will be described below. The plug 12 having the conductive material 28 face downward is superimposed on the conductive material 17 surrounded by the frame 21 of the receptacle 11. At this time, the upper surface of the conductive material 17 of the receptacle 11 and the lower surface of the conductive material 28 of the plug 12 together form a fitting plane of the thin connector, whereby the plug 12 is disposed inside the frame 21 of the receptacle 11 such that the plug 12 can slide in the X direction relatively to the receptacle 11 within the fitting plane.

Figure 10:
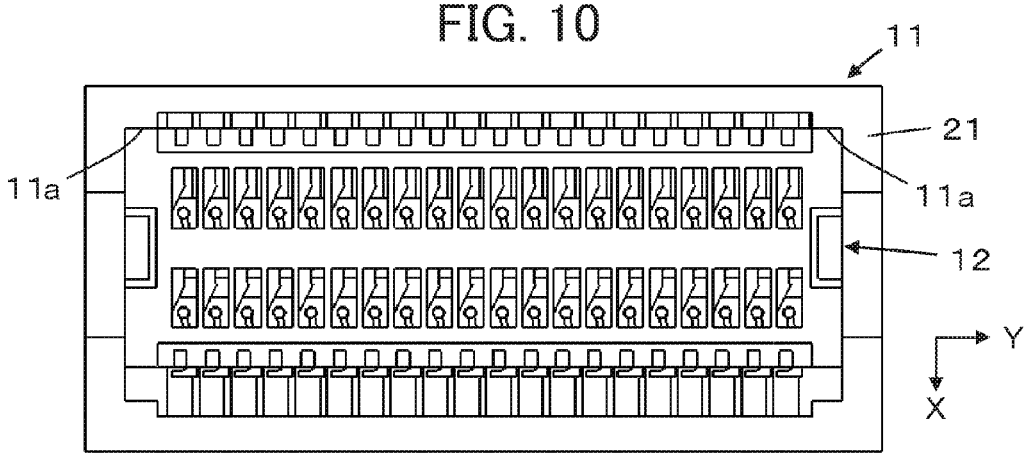
FIG. 10 is a plan view illustrating the state of the thin connector according to the embodiment before fitting.
Figure 11:
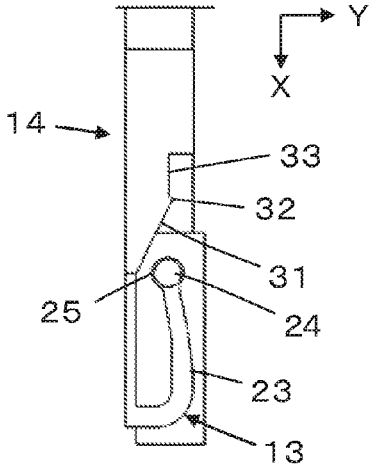
FIG. 11 is a plan view illustrating positional relation between the receptacle contact and the plug contact before fitting.

When the plug 12 is located in contact with the abutments 21*a* on the −X direction side of the frame 21 of the receptacle 11 as illustrated in FIG. 10, each of the plurality of plug contacts 14 of the plug 12 is apart from the projection portion 24 of the corresponding receptacle contact 13 of the receptacle 11 in the XY plane as illustrated in FIG. 11, and the receptacle contact portion 25 of the receptacle contact 13 and the plug contact portion 33 of the plug contact 14 are apart from each other.

Figure 12:
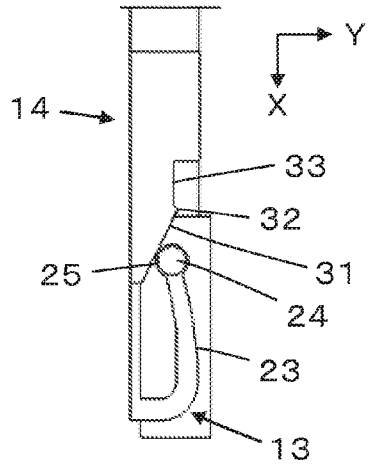
FIG. 12 is a plan view illustrating positional relation between the receptacle contact and the plug contact in the course of fitting.

Upon sliding the plug 12 in the +X direction relatively to the receptacle 11 in this state, the tapered portion 31 of each of the plug contacts 14 comes in contact with the receptacle contact portion 25 formed in the side surface of the projection portion 24 of the receptacle contact 13 as illustrated in FIG. 12, and thereafter the plug 12 slides in the +X direction, while the spring portion 23 of the receptacle contact 13 is elastically deformed in the +Y direction due to the tapered portion 31.

Figure 13:
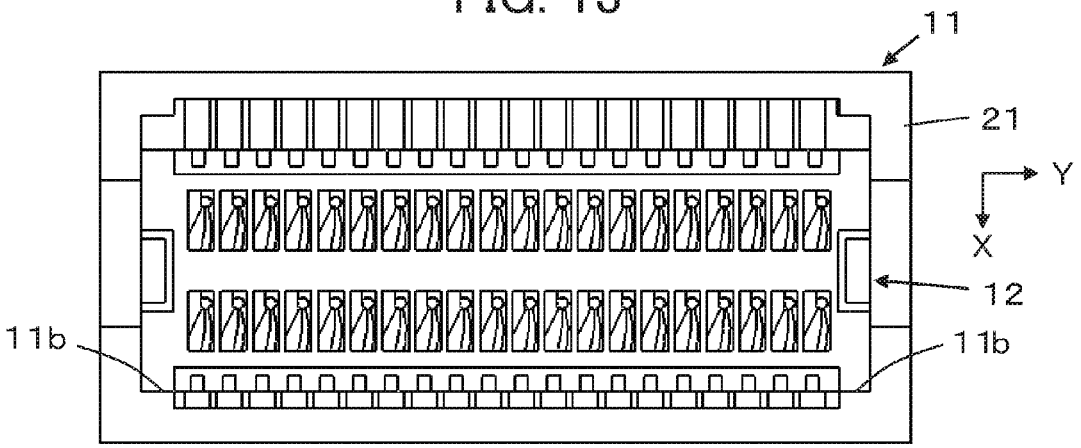
FIG. 13 is a plan view illustrating the state of the thin connector to the embodiment after fitting.
Figure 14:
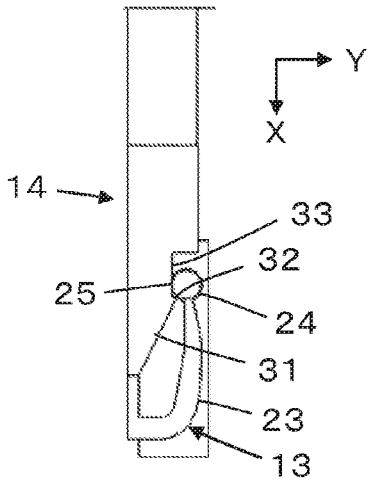
FIG. 14 is a plan view illustrating positional relation between the receptacle contact and the plug contact after fitting.

Subsequently, as illustrated in FIG. 13, the plug 12 is slid in the +X direction relatively to the receptacle 11 until the plug 12 comes in contact with the abutments 21*b* on the +X direction side of the frame 21 of the receptacle 11 so as to fit with the receptacle 11, whereby as illustrated in FIG. 14, the receptacle contact portion 25 of each of the receptacle contacts 13 and the plug contact portion 33 of the corresponding plug contact 14 are brought into contact with each other with a predetermined contact force owing to an elastic force of the spring portion 23. In this manner, the plurality of plug contacts 14 of the plug 12 are electrically connected with the corresponding receptacle contacts 13 of the receptacle 11, and the receptacle 11 and the plug 12 are fitted with each other.

Since in the plug contact 14, the plug-side projection 32 is formed at the boundary between the tapered portion 31 and the plug contact portion 33 so as to protrude in the +Y direction, a click feeling is produced in response to crossing of the receptacle contact portion 25 over the plug-side projection 32 to contact the plug contact portion 33.

Accordingly, as a result of fitting the receptacle 11 with the plug 12, the plurality of plug contacts 14 of the plug 12 are electrically connected with the corresponding receptacle contacts 13 of the receptacle 11 at a time.

In the thin connector according to the embodiment, the receptacle contact 13 has the spring portion 23 while the projection portion 24 constituting the receptacle contact portion 25 is formed at the tip end of the spring portion 23, and hence, unlike the connector of JP 2012-226977 A described above, the thin connector according to the embodiment does not require the receptacle contact to secure a space to receive a projection of the plug. Therefore, the thin connector according, to the embodiment can increase the freedom of design of the spring portion 23 and can readily narrow the arrangement pitch.

Although the thin connector according to the embodiment requires the plug 12 to have a space to receive the projection portion 24 of the receptacle contact 13, the plug 12 is provided with no spring portion, allowing the arrangement pitch to be further narrowed.

Since need for a space in the receptacle contact 13 to receive a projection of the plug is removed, by varying the spring width of the spring portion 23, the contact force between the receptacle contact portion 25 and the plug contact portion 33 can be readily adjusted.

Moreover, since the tapered portion 31 and the plug-side projection 32 of the plug contact 14 have simple planar shapes, by merely varying the taper angle of the tapered portion 31, the operation force required to elastically deform the spring portion 23 of the receptacle contact 13 to thereby fit the receptacle 11 with the plug 12 can be readily adjusted. In other words, the freedom of design both of the receptacle 11 and of the plug 12 can be increased.

In addition, since not the whole length of the spring portion 23 of the receptacle contact 13 contacts the plug contact 14, but only the projection portion 24 formed at the tip end of the spring portion 23 contacts the tapered portion 31 of the plug contact 14 and, in this state, moves to reach the plug contact portion 33, an additional effect that the spring characteristics of the spring portion 23 stabilizes can be obtained.

Figure 15:
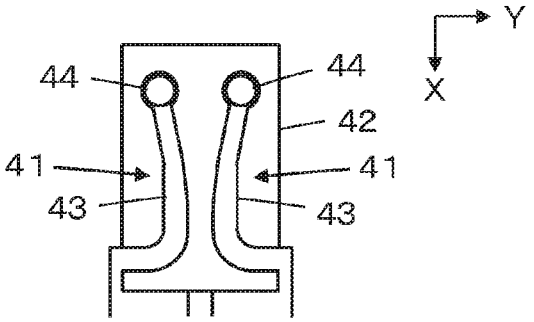
FIG. 15 is a plan view illustrating receptacle contacts used in a thin connector according to another embodiment of the present invention.

In the above-described embodiment, one rectangular opening portion 22 corresponding to each of the receptacle contacts 13 of the receptacle 11 is formed in the reinforcing plate 15 and the insulating layer 16 of the laminate 18, and one spring portion 23 composed of the conductive material 17 is formed inside the opening portion 22. However, this is not the sole case, and like an example illustrated in FIG. 15, one opening portion 42 can be formed in the reinforcing plate 15 and the insulating layer 16 to correspond to each pair of adjacent receptacle contacts 41, and a pair of spring portions 43 respectively corresponding to the pair of receptacle contacts 41 can be formed inside the opening portion 42. The pair of spring portions 43 have a bilaterally symmetric shape, and each of the spring portions 43 has a projection portion 44 at its tip end.

Figure 16:
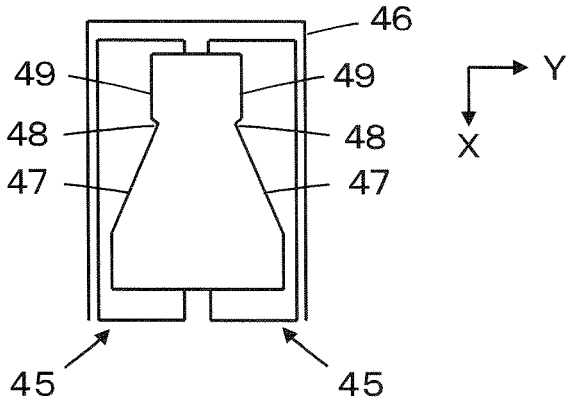
FIG. 16 is a plan view illustrating plug contacts used in the thin connector according to the other embodiment of the present invention.

In this example, also in the plug, one opening portion 46 is formed in the reinforcing plate 26 and the insulating layer 27 of the laminate 29 to correspond to a pair of adjacent plug contacts 45, and a pair of tapered portions 47, a pair of plug-side projections 48 and a pair of plug contact portions 49 respectively corresponding to the pair of plug contacts 45 are formed in the opening portion 46, as illustrated in FIG. 16. The pair of tapered portions 47, the pair of plug-side projections 48 and the pair of plug contact portions 49 each have a bilaterally symmetric shape in which the pair face each other.

Figure 17:
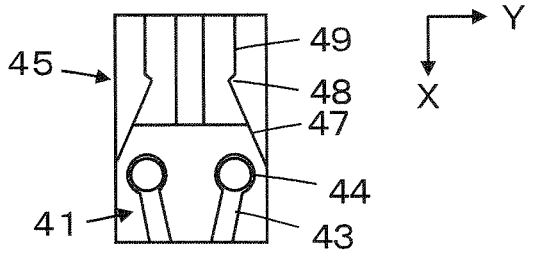
FIG. 17 is a plan view illustrating positional relation between the receptacle contacts and the plug contacts before fitting in the thin connector according to the other embodiment of the present invention.
Figure 18:
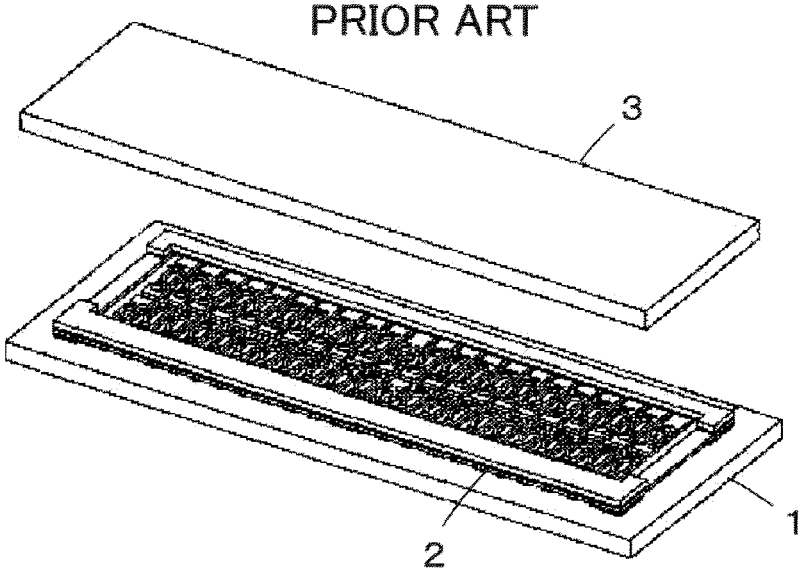
FIG. 18 PRIOR ART
FIG. 18 is a perspective view illustrating a configuration of a conventional connector.
Figure 19:
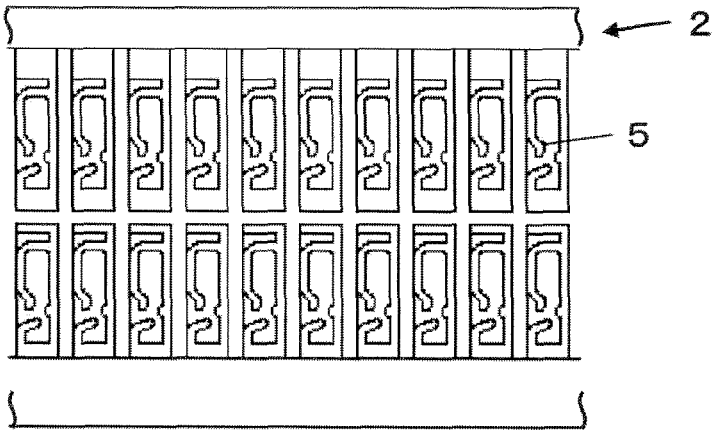
FIG. 19 PRIOR ART
FIG. 19 is a plan view illustrating a part of a receptacle used in the conventional connector.
Figure 20:
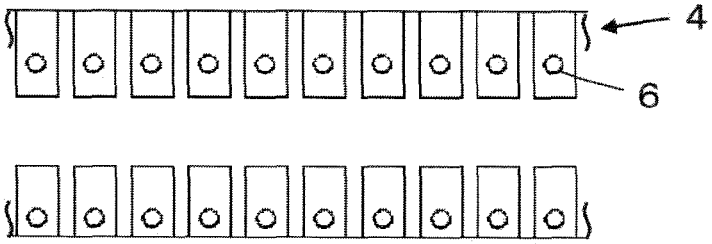
FIG. 20 PRIOR ART
FIG. 20 is a plan view illustrating a part of a plug used in the conventional connector.
Figure 21:
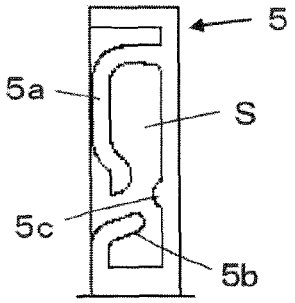
FIG. 21 PRIOR ART
FIG. 21 is an enlarged plan view illustrating a receptacle contact used in the conventional connector.
Figure 22:
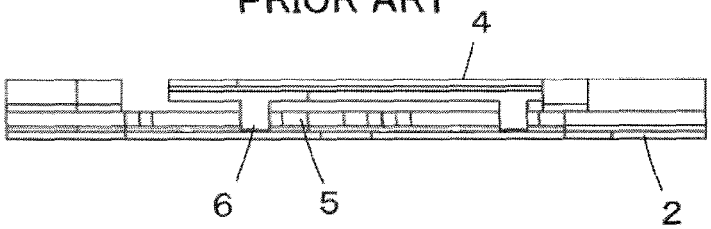
FIG. 22 PRIOR ART
FIG. 22 is a side view illustrating the conventional connector before fitting.
Figure 23:
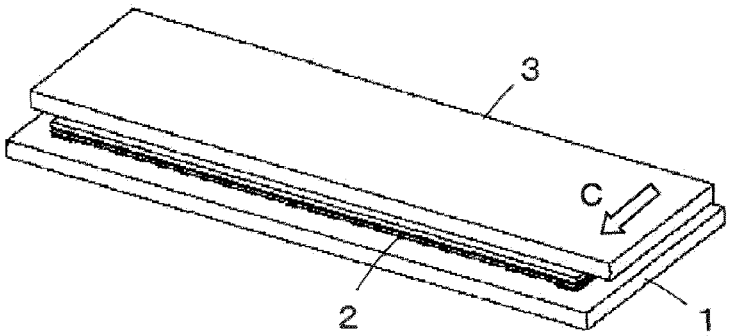
FIG. 23 PRIOR ART
FIG. 23 is a perspective view illustrating fitting behavior in the conventional connector.

When the receptacle and the plug are going to be fitted with each other, as illustrated in FIG. 17, in the opening portions 42 and 46 superimposed on each other, the tapered portions 47, the plug-side projections 48 and the contact portions 49 of the pair of plug contacts 45 respectively come in contact with the projection portions 44 of the corresponding receptacle contacts 41.

The same effect as that of the above-described embodiment can be obtained also in this configuration.

In the above-described embodiment, the receptacle 11 includes the plurality of receptacle contacts 13 arranged in two arrays, while the plug 12 includes the plurality of plug contacts 14 arranged in two arrays. However, this is not the sole case, and the plurality of receptacle contacts and the plurality of plug contacts can be arranged in a single array or in three or more arrays.

Moreover, in the above-described embodiment, the receptacle contacts 13 and the plug contacts 14 are formed by etching each of the conductive materials 17 and 28 of the laminates 18 and 29. However, this is not the sole case, and they can be formed by punching each of the conductive materials 17 and 28. For example, following formation the plurality of opening portions 22 in both the reinforcing plate 15 and the insulating layer 16 of the laminate 18 through etching, the conductive materials 17 and 28, except the spring portions, are also subjected to etching. In each of the opening portions 22, the conductive material 17 is subjected to punching to thereby form the spring portion 23. The same applies to the plug contacts 14.

Normally, a contact shape can be produced at the higher precision by punching the conductive material through a punching process rather than by etching. Hence, only a point-of-contact can be formed by punching, while the rest of the point-of-contact can be formed by etching.

Moreover, the receptacle contact or the plug contact can be formed not by using the three-layer laminates 18 and 29 but by performing electrolytic plating on a surface of an insulating layer of a two-layer laminate comprising reinforcing plate and an insulating layer.

What is claimed is:

1. A thin connector comprising a first connector having a flat plate shape and a second connector having a flat plate shape superimposed on and fitted with each other in a fitting plane, wherein the first connector includes a plurality of first contacts arrayed in a direction, each of the plurality of first contacts having a spring portion composed of a first metal member in a flat plate shape extending in a plane, a projection portion formed on the spring portion so as to protrude in a perpendicular direction to the plane of the first metal member, and a first contact portion formed on a side surface of the projection portion, wherein the second connector includes a plurality of second contacts arrayed in a same direction as the direction in which the plurality of first contacts are arrayed, each of the plurality of second contacts being composed of a second metal member in a flat plate shape and having a second contact portion formed on a side surface of the second metal member, and wherein the first connector and the second connector are superimposed on each other in the fitting plane and are slid relatively to each other within the fitting plane in a direction orthogonal to the direction in which the plurality of first contacts and the plurality of second contacts are arrayed and so that the second contact portion of each of the plurality of second contacts in the second connector comes in contact with the first contact portion of a corresponding first contact among the plurality of first contacts in the first connector, whereby the first connector and the second connector are fitted with each other.

2. The thin connector according to claim 1, wherein each of the plurality of second contacts has a tapered portion formed on the side surface of the second metal member to be adjacent to the second contact portion and a second metal member-side projection formed on the side surface of the second metal member at a boundary between the second contact portion and the tapered portion, and wherein, by sliding the first connector and the second connector relatively to each other, the projection portion of the first contact comes in contact with the corresponding tapered portion to elastically deform and move the spring portion, the projection portion then crosses over the second metal member-side projection so that the first contact portion of the projection portion then comes in contact with the second contact portion, a click feeling being produced in response to crossing of the projection portion over the second metal member-side projection.

3. The thin connector according to claim 1, wherein the spring portion of each of the plurality of first contacts has a cantilever shape, and the projection portion is formed at a tip end of the spring portion.

4. The thin connector according to claim 1, wherein the plurality of first contacts and the plurality of second contacts each includes a laminate in which a reinforcing plate, an insulating layer and a conductive material are sequentially laminated, and the first metal member and the second metal member are each made of the conductive material of the laminate.

5. The thin connector according to claim 4, wherein the plurality of first contacts are produced by etching or punching the laminate, followed by forming the projection portion on the spring portion of each of the plurality of first contacts through additive plating, and the plurality of second contacts are formed by etching or punching the laminate.

6. The thin connector according to claim 1, wherein the plurality of first contacts and the plurality of second contacts are produced by performing electrolytic plating on an insulating layer of a laminate in which a reinforcing plate and the insulating layer are laminated.

* * * * *